US010441985B2

(12) United States Patent
Vondracek

(10) Patent No.: US 10,441,985 B2
(45) Date of Patent: Oct. 15, 2019

(54) BENDING HEAD, ESPECIALLY FOR AN AUTOMATIC BENDING MACHINE

(71) Applicant: MSV SYSTEMS CZ s.r.o., Liberec (CZ)

(72) Inventor: Karel Vondracek, Liberec (CZ)

(73) Assignee: MSV Systems CZ s.r.o., Liberec (CZ)

( * ) Notice: Subject to any disclaimer, the term of this patent is extended or adjusted under 35 U.S.C. 154(b) by 321 days.

(21) Appl. No.: 15/501,958

(22) PCT Filed: Aug. 4, 2015

(86) PCT No.: PCT/CZ2015/000085
§ 371 (c)(1),
(2) Date: Feb. 6, 2017

(87) PCT Pub. No.: WO2016/019930
PCT Pub. Date: Feb. 11, 2016

(65) Prior Publication Data

US 2017/0225213 A1 Aug. 10, 2017

(30) Foreign Application Priority Data

Aug. 6, 2014 (CZ) ..... 2014-29853

(51) Int. Cl.
*B21D 11/12* (2006.01)
*B21D 7/08* (2006.01)
(Continued)

(52) U.S. Cl.
CPC ..... *B21D 7/08* (2013.01); *B21D 7/024* (2013.01); *B21D 9/05* (2013.01); *B21D 11/07* (2013.01); *B21D 11/12* (2013.01)

(58) Field of Classification Search
CPC ..... B21D 7/08; B21D 7/024; B21D 11/12; B21D 11/07; B21D 9/05
(Continued)

(56) References Cited

U.S. PATENT DOCUMENTS 5,495,740 A 3/1996 Schwarze
6,009,737 A 1/2000 Bandy
(Continued)

FOREIGN PATENT DOCUMENTS

CZ 298245 B6 8/2007
CZ 24556 U1 11/2012
(Continued)

OTHER PUBLICATIONS

PCT Search Report, dated Nov. 9, 2015.
PCT Written Opinion, dated Nov. 9, 2015.
IPRP, Feb. 7, 2017.

*Primary Examiner* — David B Jones
(74) *Attorney, Agent, or Firm* — Dority & Manning, P.A.

(57) ABSTRACT

A bending head for an automatic bending machine includes a frame. A first rotationally driven bending roll is arranged in the frame. A bending arm is transversely arranged below the first bending roll and is coupled to a bi-directional drive, with an end of the bending arm rotatable about the longitudinal axis of the first bending roll. A rotatable second bending roll is mounted to an opposite end of the bending. A bending support is configured with the first and second bending rolls. The second bending roll is rotationally coupled to the first bending roll in a forced torque transmission manner for mutual counter-direction rotation of the first and second bending rolls. The bending rolls have axially symmetric reduced lateral circumferential sections. The bending roll controls an angle of mutual rotation of both of the first and second bending rolls.

3 Claims, 4 Drawing Sheets

(51) Int. Cl.
*B21D 9/05* (2006.01)
*B21D 11/07* (2006.01)
*B21D 7/024* (2006.01)

(58) Field of Classification Search
USPC ..... 72/217
See application file for complete search history.

(56) References Cited

U.S. PATENT DOCUMENTS

| | | | | |
|---|---|---|---|---|
| 6,134,932 | A | 10/2000 | Marque et al. | |
| 6,782,728 | B2 * | 8/2004 | Latour | B21D 7/022 72/217 |
| 6,813,922 | B2 * | 11/2004 | Etienne | B21D 11/12 72/217 |
| 7,024,905 | B1 | 4/2006 | Carlson et al. | |
| 2006/0112752 | A1 | 6/2006 | Hu | |

FOREIGN PATENT DOCUMENTS

| | | | |
|---|---|---|---|
| JP | S48 93571 | A | 12/1973 |
| WO | WO 97/37785 | A1 | 10/1997 |

* cited by examiner

BENDING HEAD, ESPECIALLY FOR AN AUTOMATIC BENDING MACHINE

TECHNICAL FIELD

The invention relates to a bending head, especially for an automatic bending machine, containing first and second bending rolls and a bending support for bidirectional bending. The first bending roll is connected to a source of rotational movement. Below the first bending roll on the bending head is transversely arranged a bending arm, which is situated with its longitudinal axis perpendicular to the longitudinal axis of the first bending roll. The bending arm is mounted on the bending head with one of its ends rotatable about the longitudinal axis of the first bending roll and is coupled to a drive. The second bending roll is mounted rotatably about its longitudinal axis at the other end of the bending arm. The longitudinal axis of the second bending roll is parallel to the longitudinal axis of the first bending roll.

BACKGROUND ART

A number of automatic bending machines containing a bending head with a bending pin, a bending arm, and a bending support are well-known, for example, from the patent documents U.S. Pat. Nos. 6,009,737 and 5,495,740. The bending arm is, along with the bending pin, coupled to a bending drive for joint rotation of the bending arm and the bending pin about the longitudinal axis of the bending pin. The bending arm contains a bending plate, which is reversibly displaceable towards and away from the bending pin and is coupled to the drive. The bending head further contains a bending support, which is provided with a support plate, which is reversibly displaceable with its drive to a position in front of the bending pin and the bending arm in which the bent material is situated during a bending operation. The drives of the individual components of the automatic bending machine, i.e. the drives of the bending arm and bending support, the drives of the positioning and gripping device of the bent material, as well as the bending drive, are coupled to a control mechanism of the automatic bending machine, which coordinates their operations, thus controlling the overall operation of the automatic bending machine.

CZ PV 2006-289 discloses a bending head for an automatic bending machine containing a longitudinal bed with a positioning and gripping device, whereby the bending head contains a bending support with an adjustable support plate that is provided with a shape groove for the bent material and is coupled to a drive coupleable to the control mechanism of the automatic bending machine. The support plate is mounted on a support pin, which is slidingly mounted in the body of the bending support, whereby it is coupled to an outlet member of a linear drive that is coupled to the control mechanism of the automatic bending machine. The bending support is provided with a locking device of the bending plate.

CZ UV 24556 describes a bending device containing a longitudinal bed with a movable positioning and gripping device, which is aligned with a bending head containing a jointly rotatable bending pin and bending arm with an adjustable bending plate. The longitudinal bed is made up of longitudinal segments, whereby at one end of the longitudinal bed is selectably mounted a linear magnetic motor coupled to a positioning and gripping device or an electric servo motor with a motion belt coupled to the positioning and gripping device. At the other end of the longitudinal bed is located a vertically and laterally adjustable bending head, whose bending arm is selectably situated on the right or left side of the bending head. The bending plate on the bending arm is selectably composed of a bending stone or a bending roll, or a bending roll with defined rolling away along the bent material during the bending operation.

A common disadvantage of the bending heads known so far from the background art is the fact that, without substantial rearrangement, they only allow to perform bends in one direction, i.e. by turning the bending roll either only to the right, or only to the left. If need arises to change the direction of bending, it is necessary either to use two separate bending heads with opposing rotation direction of the bending roll, which is demanding in economic terms and decreases the effective utilization of the two bending heads, or it is necessary to rearrange the bending head to enable the opposite direction of rotation of the bending roll, which is economically challenging, since during the rearrangement the bending machine is blocked and is out of operation, or it is necessary to turn the bent material, which places increased demands on handling devices and the space around the bending machine, as a number of bent products have a relatively large length. Another disadvantage of the background art is the fact that the feasibility of conducting two or more bends in immediate succession is limited, or it can only be done with a minimal length of a straight section between the bends.

The aim of the invention is to enable selectable and fast utilization of bends in both directions on a single device without having to rearrange the device, while still maintaining productivity, accuracy, sufficient simplicity of the device and its long service life, and at the same time to allow individual bends to be arranged immediately one after another or only with a minimal spacing, i.e. minimal straight sections between each other.

SUMMARY OF THE INVENTION

Objects and advantages of the invention will be set forth in part in the following description, or may be obvious from the description, or may be learned through practice of the invention.

The goal of the invention is achieved by a bending head, especially for an automatic bending machine, whose operational principle consists in that the second bending roll is coupled to the first bending roll by forced torque transmission for mutual forced common counter-direction movement of both bending rollers. Both bending rolls are provided with mutually axially symmetrical reduced sections of their circumference. The first bending roll is coupled to a drive for its rotary motion and controls angle of mutual rotation of both bending rolls.

The advantage of this arrangement is the fact that it is possible to carry out both "left" bends and "right" bends without having to rearrange the bending head and, at the same time, to conduct bends spaced with minimum distances between each other, i.e. bends with a minimum length of straight sections between each other, or even bends immediately following each other, i.e. bends without straight sections between each other.

DESCRIPTION OF DRAWINGS

The invention is schematically represented in the drawings, where.

DETAILED DESCRIPTION

Figure 1:
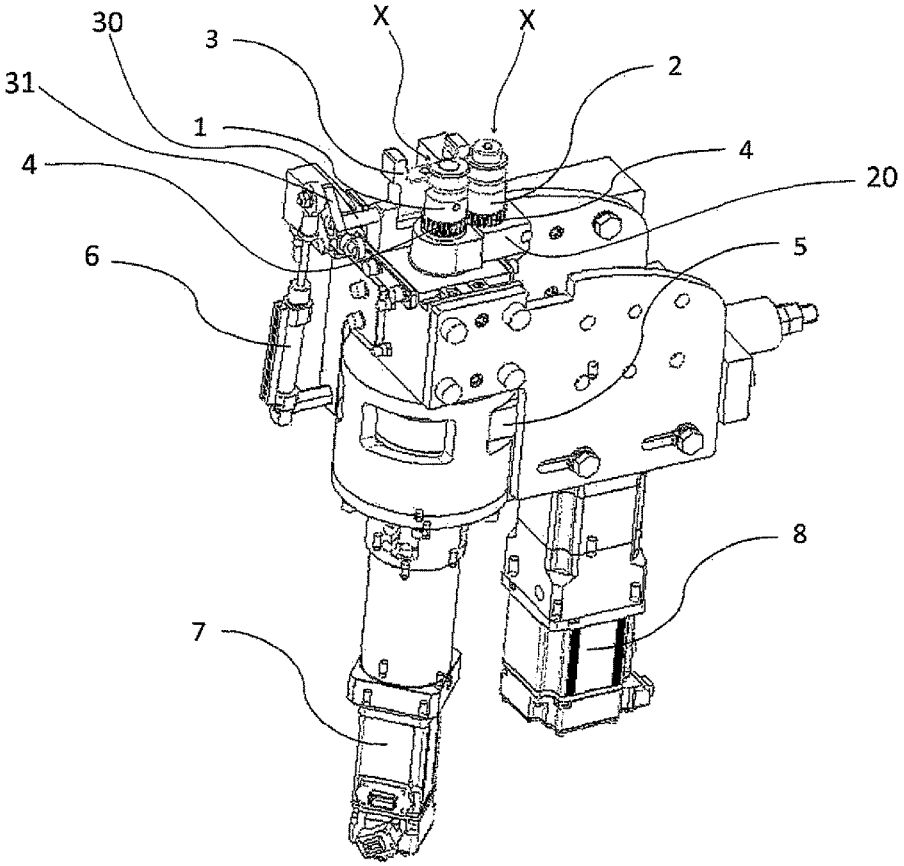
FIG. 1 shows an overall view of a bending head.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The invention will become apparent from the description of an embodiment of a bending head for an automatic bending machine provided with a gripping device and, where appropriate, also with a positioning device of the bent material 0. The individual components of the machine, including the bending head, are provided with drives and are connected to a control mechanism of the bending machine, so that bends can be formed at a desired location of the bent material 0, in a desired direction, and at a desired angle. In addition, the bending head according to the invention is designed for carrying out bends in both directions, i.e. both to the right and to the left, and, at the same time, it is designed for performing bends immediately one after another, or only with a minimal length of straight sections between the individual bends.

Generally, the bending head is situated at the end of the machine and contains the first bending roll 1, which is mounted rotatably about its longitudinal axis in the frame of the bending head and is connected to a source of rotary motion. The first bending roll 1 is provided along its circumference with a shape groove as shown in FIG. 1 for the bent material 0, such as a tube, a pipe, a bar etc.

Below the first bending roll 1 on the bending head is transversely arranged a bending arm 20, which is situated with its longitudinal axis perpendicularly to the longitudinal axis of the first bending roll 1. The bending arm 20 is mounted on the bending head with one of its ends rotatably mounted about the longitudinal axis of the first bending roll 1.

The second bending roll 2 is mounted rotatably about its longitudinal axis at the other end of the bending arm 20, whereby the longitudinal axis of the second bending roll 2 is parallel to the longitudinal axis of the first bending roll 1 and, at the same time, is perpendicular to the longitudinal axis of the bending arm 20.

As a result, both bending rolls 1, 2 are rotatably mounted on the bending arm 20 about their parallel longitudinal axes, whereby the second bending roll 2, due to being mounted on the bending arm 20, is able to revolve around the first bending roll 1. The bending arm 20 is coupled to a drive for its bidirectional rotary motion, e.g., with a rotary motor 8, which is the drive of bidirectional bending.

As is apparent from the above description, the bending arm 20 is disposed transversely with its longitudinal axis to both rolls 1, 2 and is rotatable about the longitudinal axis of the first bending roll 1, whereby the second bending roll 2 moves together with the bending arm 20.

The first bending roll 1 is, with the aid of forced torque transmission means, rotatably coupled to the second bending roll 2. Consequently, the second bending roll 2, during the rotation of the bending arm 20 about the longitudinal axis of the first bending roll 1, continuously rolls away with its lateral surface substantially over the lateral surface of the first bending roll 1 or, if the two rolls 1, 2 do not directly abut each other with their lateral surfaces, it rolls away in the vicinity of the lateral surface of the first bending roll 1.

So as to facilitate insertion and removal of the bent material 0 into and from the bending shape groove in each of the bending rolls 1, 2 and, above all, so as to minimize or completely eliminate straight sections of the bent material 0 between the individual bends so that the bends would directly follow each other, both bending rolls 1, 2 are provided with mutually corresponding (i.e. mutually functionally coordinated) reduced lateral sections X of their circumference, the reduced section X having a shape of a cut-off circular segment in a plan view, as shown in FIGS. 2 to 7.

Mutual coordination of the function of the reduced circumference sections X of each of the bending rolls 1, 2 is achieved by the above mentioned forced torque transmission means between the two bending rolls 2, which thus rotate jointly counter-directionally. The reduced sections X are always located mutually axially symmetrically to the axis situated in a common tangent line to both bending rolls 1, 2. By joint forced mutually counter-directional motion of the two bending rolls 1, 2, it is possible not only to restrain or prevent possible skidding of the bending rolls 1, 2, particularly of the second bending roll 2, over the surface of the bent material 0, such as tubes, pipes, and to prevent possible damage to the surface of the bent material 0, but mainly it is possible to achieve synchronization of the movement and position of the reduced circumference sections X of the two rolls 1, 2 in accordance with the principles of axial symmetry, as will be described in greater detail further on in the section dealing with the function of the bending head.

In the illustrated embodiment, the forced torque transmission means of both rolls 1, 2 are formed by a pair of toothed wheels 4 that are in mutual engagement, wherein one toothed wheel 4 is mounted below the first bending roll 1 and the other toothed wheel is mounted below the second bending roll 2. Each of the toothed wheels 4 is secured against being turned relative to the bending roll 1, 2 below which it is arranged, e.g., it is pinned to this roll or otherwise suitably connected. For the purpose of synchronized rotation of both rolls 1, 2, which is used during setting the mutual mirror position of the reduced lateral circumference sections X of each of the rolls 1, 2 when need arises to carry out a bend by a defined angle and with a minimal length of straight sections between the and both when inserting and removing the bent material 0 into and from the bending shape groove in each of the bending rolls 1, 2, the first bending roll 1 is coupled to the drive of its rotary motion, e.g., to a rotary motor 7, so that the rotary motion of the first bending roll 1 is mirror transmitted into the rotary motion of the second bending roll 2. The drive of the first bending roll 1 is provided with monitoring the position of the shaft, thus enabling the turning of the first bending roll 1, and, consequently, also of the second bending roll 2, into the accurately required axially symmetrical mutual position of the lightweight sections X of the circumference of both rolls 1, 2.

The pair of bending rolls 1, 2 is further aligned with a bending support 3 for bidirectional bending, which is used to absorb reaction forces occurring during the bending of the bent material 0 between the bending rolls 1, 2 and their mutual movement both to the left and to the right due to the second bending roll 2 being mounted on the transverse bending arm 20. In the illustrated example of embodiment, the bending support 3 is composed of a flat body, which is swingingly mounted in the frame of the bending head, e.g., it is mounted at one end of a pivot 30 that is rotatably mounted in the frame of the bending head. At its other end, the bending support 3 is coupled to the drive of its rotary motion, e.g., at its other end it is provided with a control lever 31, to which is connected a movable part of a linear drive 6, whose fixed part is mounted on the frame of the bending head.

Figure 2:
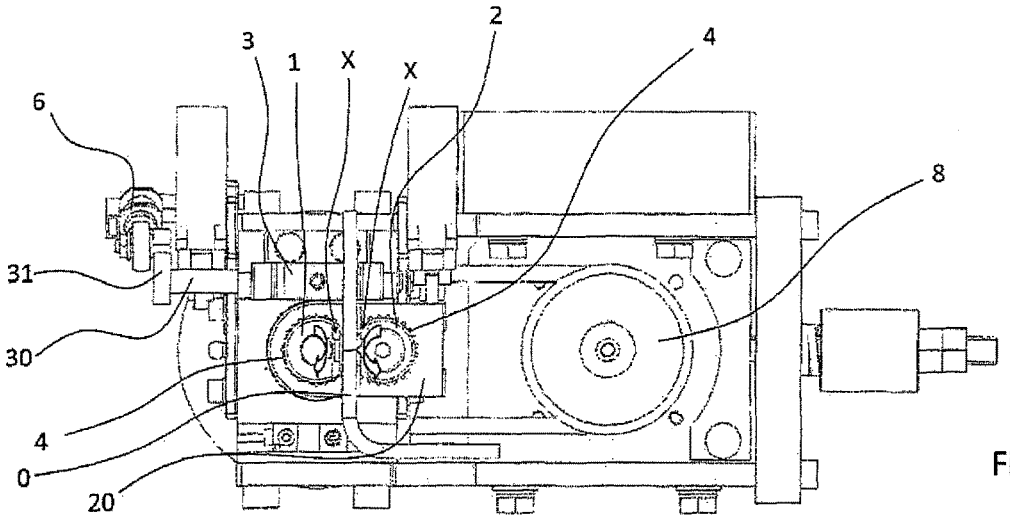
FIG. 2 shows a plan view of the bending head at the moment of the bending rolls being opened for inserting a bent tube and setting the head for bending to the left side.
Figure 3:
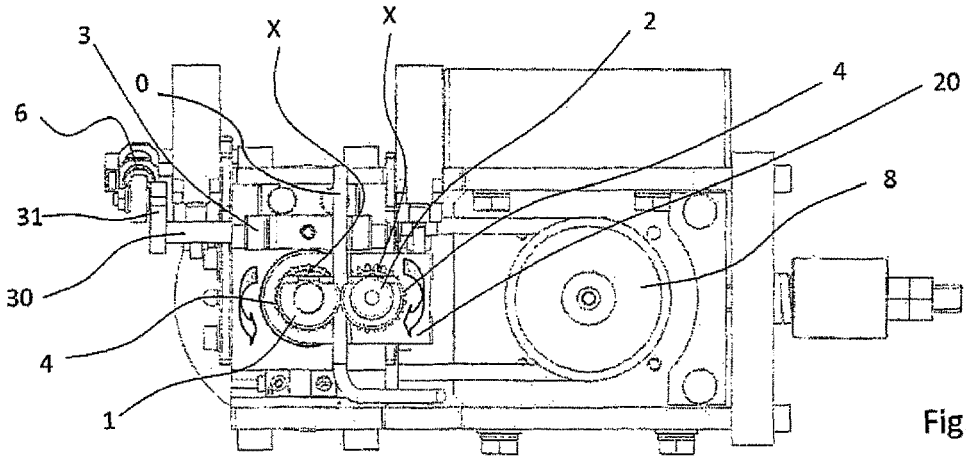
FIG. 3 shows a plan view of the bending head after closing the bending rolls for inserting a bent tube for bending to the left.
Figure 4:
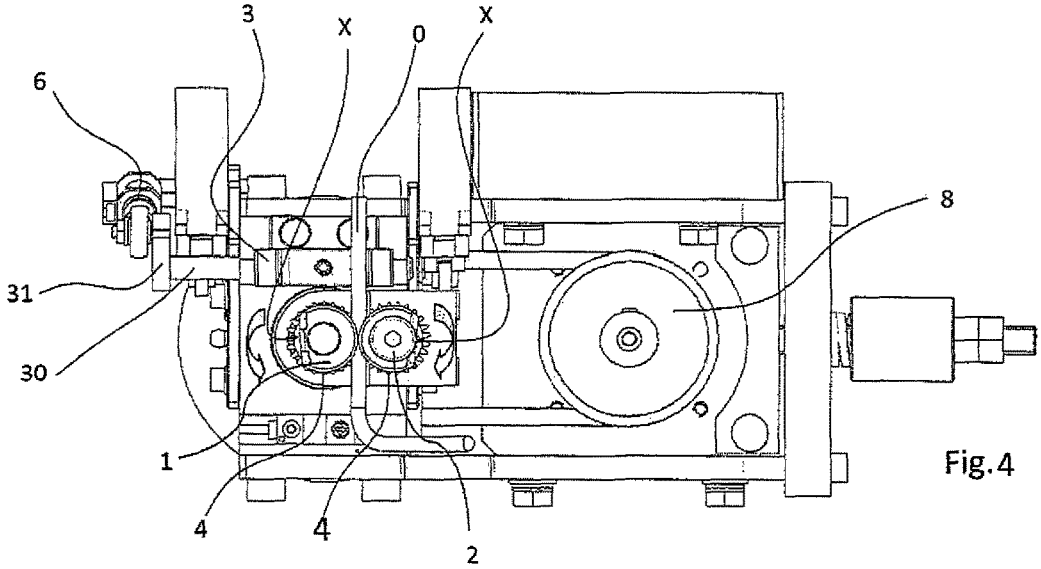
FIG. 4 is a plan view of the bending head with an inserted bent tube and the bending rolls turned to the initial position for bending by 85° to the left.

The bending head operates such that when it is necessary to perform a bend to the left, the bending arm 20 turns so that the second bending roll 2 is situated (in a plan view) on the right of the first bending roll 1, see FIGS. 2 to 4, whereupon both rolls 1, 2 turn with their lightweight sections X of the lateral circumference against each other (by turning the first bending roll 1 about its longitudinal axis, whereby this rotary motion is transmitted via the toothed wheels 4 to the second bending roll 2). Subsequently, the bent material 0 is inserted into the gap formed by the reduced sections X in the lateral walls of the rolls 1, 2 and both rolls 1, 2 reversibly turn about their longitudinal axes, by which means the sections X in the lateral walls of the rolls 1, 2 tilt away from each other into a position which does not hinder subsequent bending, and so the bent material 0 is closed between the bending rolls 1, 2 to perform the bending operation. When inserting and removing the bent material 0 into and from the rolls 1, 2, the bending support 3 is tilted down not to hamper the handling operations in the vicinity of the rolls 1, 2. The bending operation itself is carried out by turning the bending arm 20 to the left about the longitudinal axis of the first bending roll 1 to reach the desired angle, see FIG. 5, and then backwards. After the bending arm 20 returns back, both rolls 1, 2 again turn against each other about their longitudinal axes until the reduced circumferential sections X in the lateral walls of the rolls 1, 2 face each other, thereby releasing the bent material 0 for further handling and for setting up for another bend.

Figure 6:
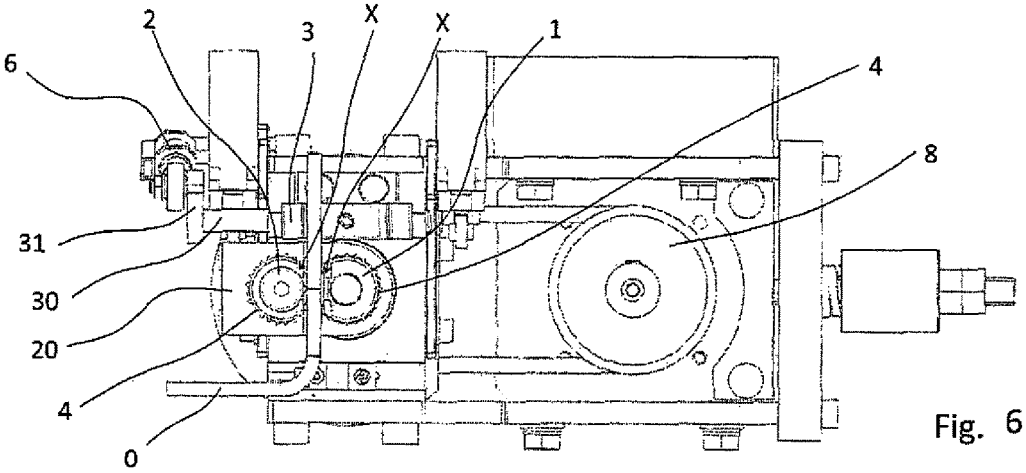
FIG. 6 is a plan view of the bending head at the moment of rearrangement of the bending rolls for a bend to the right and with opened bending rolls for inserting the bent tube.
Figure 7:
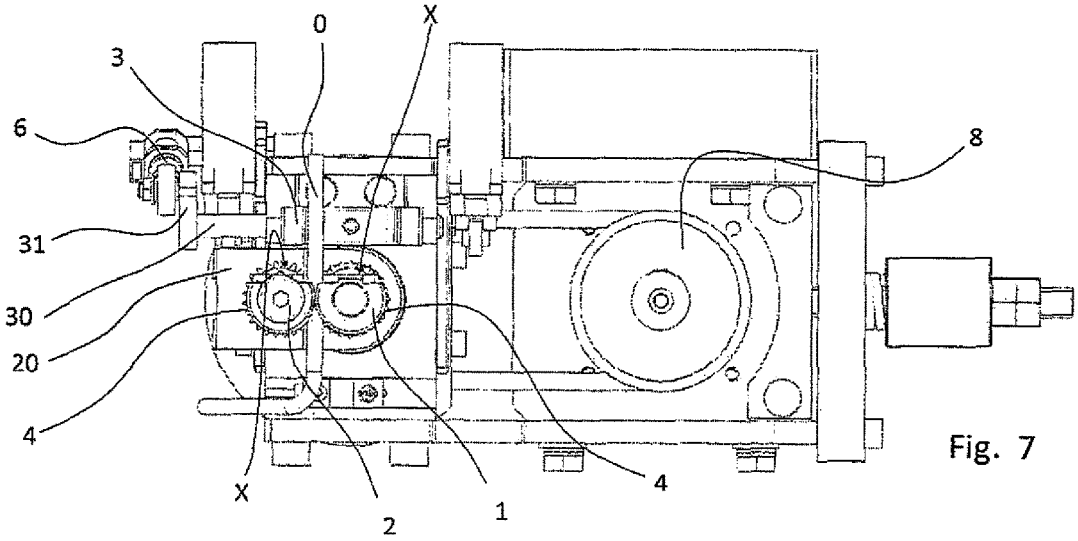
FIG. 7 is a plan view of the bending head from FIG. 6 for closing the bending rolls after inserting the bent tube for a bend to the right.
Figure 8:
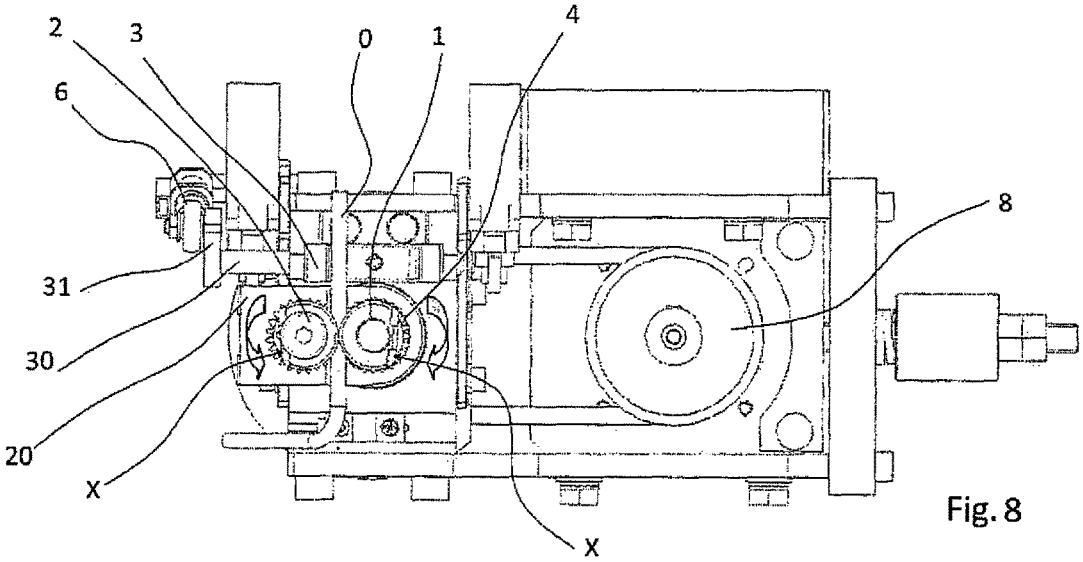
FIG. 8 shows the turning of the bending rolls for bending to the right by 85° with a minimal straight section between the preceding and following bends.
Figure 9:
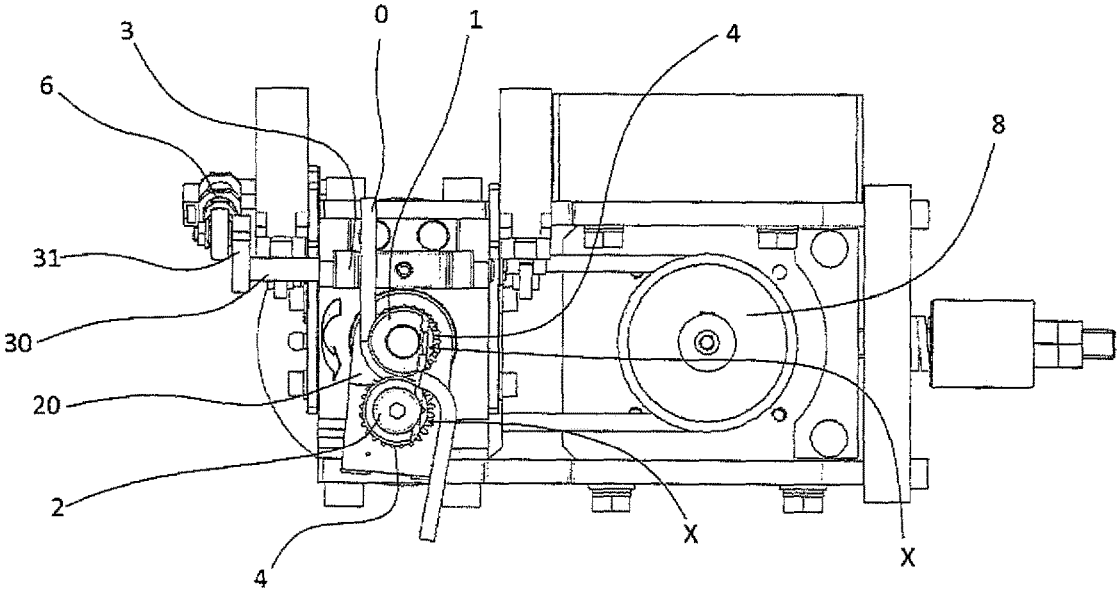
FIG. 9 shows carrying out a bend by 85° to the right with a minimal straight section between the preceding and following bends and with the final mutual position of the bending rolls.

When it is necessary to perform a bend to the right, the bending arm 20 turns in such a manner that the second bending roll 2 is situated (in a plan view) on the left side of the first bending roll 1, see FIGS. 6 and 7, whereupon both rolls 1, 2 turn with their reduced circumferential sections X facing each other (by turning the first bending roll 1 about its longitudinal axis) and this rotary motion is transmitted via the toothed wheels 4 to the second bending roll 2. Subsequently, the bent material 0 is inserted into the gap formed by the reduced circumferential sections X and both rolls 1, 2 turn reversibly about their longitudinal axes, by which means the reduced circumferential sections X tilt away from each other to a position that does not hamper the subsequent bending, and so the bent material 0 is closed between the bending rolls 1, 2 for bending. When inserting or removing the bent material 0 into and from the rolls 1, 2 the bending support 3 is tilted down to allow unrestricted handling operations in the vicinity of the rolls 1, 2. The bending operation itself is carried out by turning the bending arm 20 to the right about the longitudinal axis of the first bending roll 1 to reach the desired angle and then backwards. After the bending arm 20 returns back, both rolls 1, 2 again turn about their longitudinal axes until the reduced sections X in the lateral walls of the rolls 1, 2 face each other, thereby releasing the bent material 0 for further handling operations and for setting up for another bend.

If a change in parameters of bending is required, e.g., a change in the bend radius, or when the bent material 0 has a different size or shape of the inter-section, the bending rolls 1, 2 are replaced, and, in case of need, also the toothed wheels 4 are replaced, the bending support 3 and, as the case may be, the individual parts of the bending head 3 are adjusted to achieve the desired final and initial positions, whereby the program according to which the bending head is controlled, also depending on other parts of the bending machine, is modified or a new program is used etc.

Figure 5:
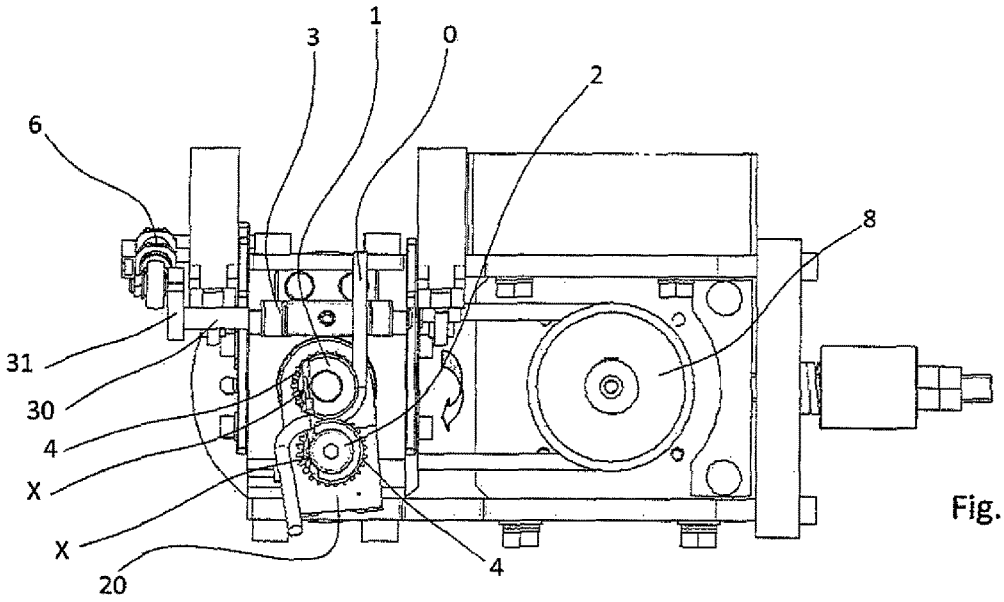
FIG. 5 is a plan view of the bending head after performing a bend by 85° to the left (FIG. 4) with the indicated mutual position of mutually corresponding lightweight sections of the circumference of both bending rolls.

During a bending operation with the requirement for a minimal or zero straight section between the individual bends, it is necessary to make sure that the circumference of none of the bending rolls 1, 2 intersects the position of the bent material 0 from the preceding bend, because otherwise it would not be possible to perform the bend. Therefore, prior to carrying out the subsequent bend with a small or no spacing from the preceding bend, it is necessary for both rolls 1, 2, to turn with their reduced sections X into such an initial position that after performing a bend to reach the desired angle (the rolls 1, 2 mutually roll away from each other during the bending operation), both rolls 1, 2 end up with their reduced sections X in a common line, as shown in FIG. 5, which illustrates the final mutual position of both rolls 1, 2 and the reduced sections X when turning by an angle of 85°, whereby the initial mutual position of both rolls 1, 2, and the reduced sections X for this bend is shown in FIG. 4.

Modifications and variations can be made to the embodiments illustrated or described herein without departing from the scope and spirit of the invention as set forth in the appended claims.

The invention claimed is:

1. A bending head for an automatic bending machine, comprising:

a frame;

a first bending roll arranged in the frame and rotatable about a longitudinal axis of the first bending roll, the first bending roll connected to a driving rotational source within the frame;

a bending arm below the first bending roll with al longitudinal axis transverse to the longitudinal axis of the first bending roll, the first bending roll rotatably mounted on the bending arm;

a bi-directional drive coupled to the bending arm to bi-directionally rotate an end of the bending arm about the longitudinal axis of the first bending roll;

a second bending roll mounted to an opposite end of the bending arm, the second bending roll rotatable about a longitudinal axis that is parallel to the longitudinal axis of the first bending roll;

a bending support comprising a body adjacent to the first and second bending rolls with an end pivotally mounted to the frame, wherein the body is tiltable to remove and insert bent material between the first and second bending rolls;

the second bending roll rotationally coupled to the first bending such that driving rotation of the first bending roll produces counter-direction rotation of the second bending roll and the first bending roll thereby controls an angle of mutual rotation of both of the first and second bending rolls;

each of the first and second bending rolls further comprising a cut-off circumferential section in a plan view, wherein the cut-off circumferential sections define reduced axially symmetric lateral circumferential sections that define a gap for insertion and removal of bent material from between the first and second bending rolls.

2. The bending head according to claim 1, wherein each of the first and second bending rolls is configured with a rotationally-fixed toothed wheel, wherein the toothed wheels are in engagement to rotationally couple the second bending roll and the rotationally-driven first bending roll.

3. The bending head according to claim 1, wherein the cut-off circumferential section of each of the first and second bending rolls is formed by a straight planar cut-off segment.

* * * * *